US005101610A

United States Patent [19]

Honegger

[11] Patent Number: 5,101,610

[45] Date of Patent: Apr. 7, 1992

[54] METHOD OF PROCESSING PRINTING PRODUCTS ARRIVING IN AN IMBRICATED FORMATION

[75] Inventor: Werner Honegger, Tan Rüti, Switzerland

[73] Assignee: Ferag AG, Hinwil, Switzerland

[21] Appl. No.: 660,749

[22] Filed: Feb. 26, 1991

[30] Foreign Application Priority Data

Aug. 28, 1990 [CH] Switzerland ..... 2-796/90

[51] Int. Cl.[5] ..... B65B 13/02; B65B 63/04

[52] U.S. Cl. ..... 53/430

[58] Field of Search ..... 53/430, 118, 117, 116; 242/67.1 R

[56] References Cited

U.S. PATENT DOCUMENTS 3,263,390 8/1966 Dexter ..... 53/430 X
4,550,883 11/1985 Boss ..... 53/118 X
4,688,368 8/1987 Honegger ..... 53/430 X
4,844,256 7/1989 Honegger ..... 53/430 X
4,866,910 9/1989 Reist ..... 53/118 X

*Primary Examiner*—James F. Coan
*Attorney, Agent, or Firm*—Fleit, Jacobson, Cohn, Price, Holman & Stern

[57] ABSTRACT

Printing products, arriving in an imbricated formation, have a certain formation length and approximately equal imbrication spacings. An imbrication-like formation is formed by pushing together the printing products and, at the same time, shortening the imbrication spacing. The imbrication-like formation is rolled up, together with a wrapping element, into a roll-shaped bundle. An end user then unrolls the bundle and pushes the imbrication-like formation together to form a vertical stack. For this purpose, the length of the imbrication-like formation length is chosen such that the same person can grasp, with his hands, the ends of the formation at the same time. Individual printing products may then be removed from the stack.

12 Claims, 4 Drawing Sheets

METHOD OF PROCESSING PRINTING PRODUCTS ARRIVING IN AN IMBRICATED FORMATION

BACKGROUND OF THE INVENTION

1. Field of the Invention

The present invention relates to a method of processing printing products, such as newspapers, periodicals and the like, arriving in an imbricated formation of a certain length and having an approximately equal imbrication spacing between adjacent products. The invention additionally relates to a bundle produced by this method.

2. Description of Related Art

Methods of this type are known, for example, from German Patent Publication 33 30 485 and U.S. Pat. Nos. 4,688,368 and 4,844,256. In these methods, the printing products, arriving in an imbricated formation of a certain length and with approximately equal imbrication spacings between the products, are rolled up, beginning from one end of the imbricated formation. A wrapping or strap is laid around the printing product roll which is thus formed, and holds the printing product roll together. The bundle, thus formed, is ready to dispatch, and is able to be manipulated by hand. Such a bundle is extremely stable and simple to handle. The individual printing products are removed from the center of the bundle.

An apparatus for producing such portable, tubular bundles is known, for example, from European Patent Application 313 781 and corresponding U.S. Pat. No. 4,909,015. Furthermore, European Patent Application 243 906 and corresponding U.S. Pat. No. 4,811,548 teach how to improve the handling of such bundles by providing the bundles with a carrying loop, which consists of an elongated carrying element running through the inside and on the outside of the printing product roll.

However, the end users of bundles of printing products, for example, kiosk vendors or newspaper and periodical contractors, often prefer, for individual or multiple removal of printing products, that the products be arranged in a stack-shaped bundle rather than a tubular bundle. As is generally known, in order to comply with this preference, the printing products, arriving in an imbricated formation, are stacked vertically in a vertical stacking compartment and pressed together. Such is disclosed, for example, in German Patent Publication 27 52 514 and corresponding U.S. Pat. No. 4,140,052. There subsequently follows an intermediate transportation of the stack of printing products, which lie loosely, one on top of the other, to a packing station. In the packing station, the stack is provided, by means of a wrapping machine, with a protective wrapping. Such a wrapping may be, for example, of plastic sheet, and the wrapped stack is subsequently strapped to keep it together. For this strapping, which is often what is known as a "cross-strapping", cord or plastic strip is usually used. The end user then has to remove this strapping and the protective wrapping. However, the production of such stacked, ready-to-dispatch bundles is much more complicated than the production of tubular bundles. Furthermore, tubular bundles can be stacked, i.e., on pallets, more stably than conventionally stacked bundles for dispatch with longitudinal axes of the bundles running vertically.

SUMMARY OF THE INVENTION

It is an object of the present invention to propose a method which, while utilizing the handling and production advantages of roll-shaped bundles of printing products, which can easily be manipulated by hand, also offers the end user the possibility of being able to remove individual printing products from a stack.

The printing products, arriving in an imbricated formation, are pushed together into an imbrication-like formation having a formation length which is carefully selected. In particular, the formation length is chosen such that the end user can, after unrolling the bundle, still grasp, with his hands, the two opposite ends of the formation at the same time. This enables him to easily push the printing products onto one another to form a stack in a small space.

In the case of a particularly preferred embodiment of the method, the formation of an extremely compact bundle is permitted, since the printing products arranged in the innermost portions of in the bundle can be rolled very tightly with a great imbrication spacing.

BRIEF DESCRIPTION OF THE DRAWINGS

The present invention will now be explained in further detail with reference to the drawings.

DESCRIPTION OF THE PREFERRED EMBODIMENTS

Figure 1:
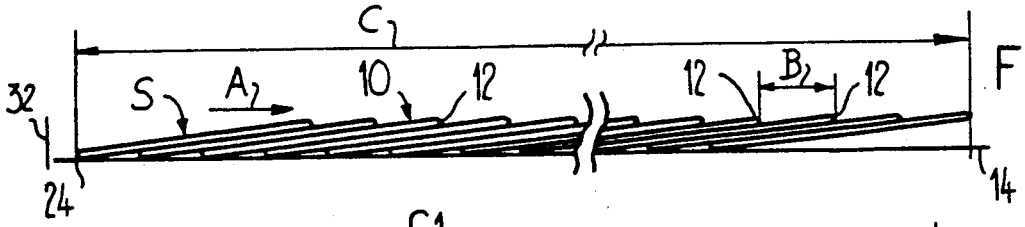
FIG. 1 shows printing products arriving in an imbricated formation of a certain length.

FIG. 1 shows printing products 10 arriving in an imbricated formation S in a direction indicated by arrow A. Each printing product 10 rests on the preceding one. The printing products 10 are periodicals or newspapers, which are arranged with their folded edges 12 leading, i.e., oriented toward the front of, the imbricated formation S, indicated by arrow A. The imbrication spacing between the folded edges 12 of successive printing products 10 is denoted by B, and is approximately constant for all of the printing products !0 in the formation. The imbricated formation S, which has an overall length C, as shown in FIG. 1, may be a section of a much longer formation, such as one which is formed, for example, by rotary printing machines. In this case, each section is separated from the longer formation by forming gaps between the sections. If, for example, the imbricated formation S comprises one hundred printing products, having a mutual, i.e.. common imbrication spacing of approximately 0.1 meters (m), the length C is about 10 m. The imbricated formation S rests on a belt conveyor 14, illustrated schematically, and is transported in the direction indicated by arrow A.

Figure 2:
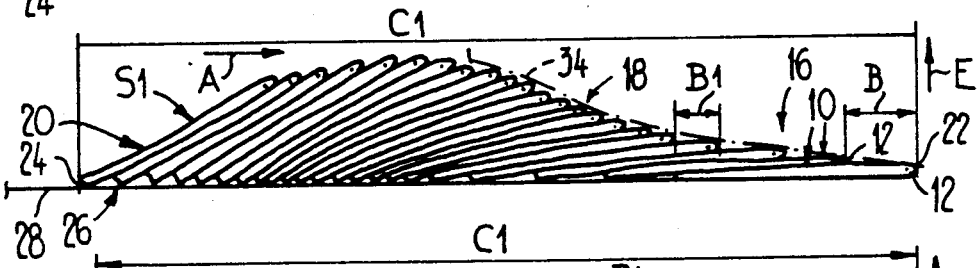
FIGS. 2 and 3 show printing products arranged in an imbrication-like formation of variable thickness and having different mutual imbrication spacing.

FIG. 2 shows an imbrication-like formation S1, which is produced by pushing together the printing products 10 of the imbricated formation S according to FIG. 1. In a front end section 16 of the imbrication-like formation S1, the imbrication spacing B between the folded edges 12 of successive printing products 10 substantially corresponds to the imbrication spacing B shown in FIG. 1. In the embodiment shown, the front end section 16 extends over the region of the leading folded edges 12 of the first four printing products 10. In a region 18 adjoining the front end section 16, the spacing between the folded edges 12 of successive printing products 10 is reduced, as is indicated, for example, by the arrow B1. In this region 18, the imbrication spacing B1 decreases approximately continuously in a direction opposite to the direction indicated by an arrow A. In a rear end section 20, adjoining the region 18, the spacing between the leading folded edges 12 of successive printing products 10 remains approximately constant, or may increase slightly. In the case of an imbrication-like formation S1 resting on a flat support, this arrangement of the printing products 10 results in a wave-shaped envelope curve, with a single wave crest between the leading end 22 and the trailing end 24 of the imbrication-like formation S1. Pushing the printing products 10 together, thereby shortening the imbrication spacings B, B1, and causing the imbricated formation S to take the form of imbrication-like formation S1, results in a formation length C1. Although the imbrication-like formation S1 has the same number of printing products 10 as the imbricated formation S, it has a length C1, which is considerably smaller than the length C. The formation length C1 is chosen such that a person can reach the leading end 22 and the trailing end 24 of the imbrication-like formation S1 at the same time with his hands. Consequently, the preferred formation length C1 is between 0.8 and 1.5 m. However, it is also possible to make this formation length somewhat shorter or somewhat longer.

Figure 6:
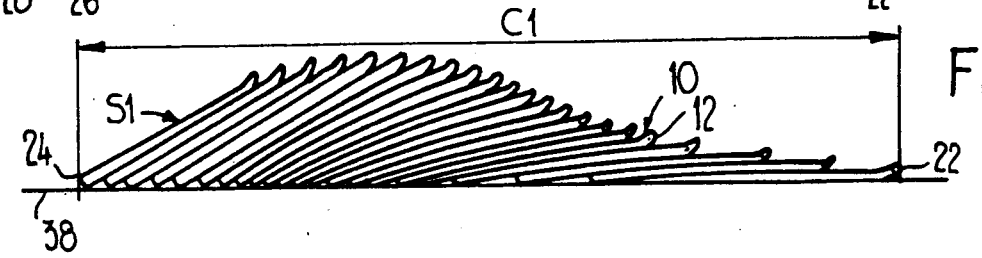
FIG. 6 shows the imbrication-like formation shown in FIG. 2 after unrolling.
Figure 5:
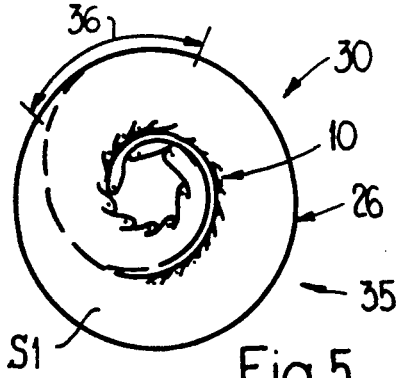

Underneath the imbrication-like formation S1, a part of a wrapping element 26 is shown. The rear end region 28 of the wrapping element 26 projects beyond the trailing end 24 and overlaps the imbrication-like formation S1 by extending from the trailing end to the region of the forwardmost printing product 10. This wrapping element 2 is preferably a sheet of plastic or kraft paper, which has a width which is approximately the same as the width of the printing products 10. Of course, this wrapping element 26 may also be narrower or wider than the printing products 10. The rear end region 28 of the wrapping element, projecting beyond the imbrication-like formation S1, is chosen to be of such a length that after rolling it up together with the imbrication-like formation S1, in a manner which is described in more detail below, it reaches, in the circumferential direction, around the entire printing product roll 30 thus formed, as shown in FIGS. 5 and 6.

Figure 3:
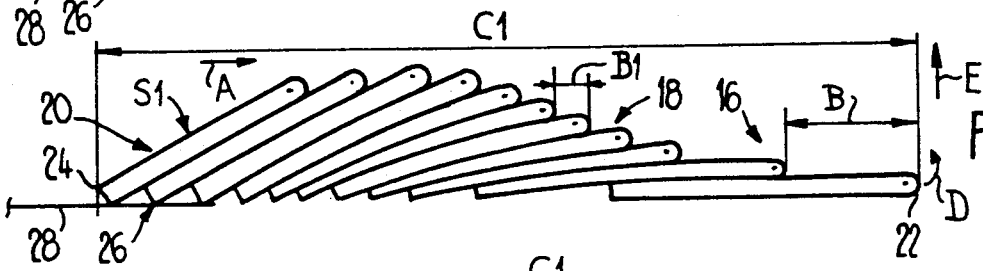

FIG. 3 likewise shows an imbrication-like formation S1, the envelope curve of which corresponds approximately to the envelope curve of the imbrication like formation S1 shown in FIG. 2. The difference is that fewer, but thicker, printing products 10 have been pushed together to form the imbrication-like formation S1. Also, in the imbrication-like formation S1 shown in FIG. 3, the imbrication spacing B at the front end section 16 is greater than in the region 18 adjoining it in a direction opposite to the direction of arrow A. A shortened imbrication spacing B1 is indicated by way of example.

In FIG. 3, the wrapping element 26 projects with its rear end region 28 beyond the trailing end 24 of the imbrication-like formation S1, but overlaps the latter only in a rear end section 20. The formation length C1, between the leading end 22 and trailing end 24, corresponds approximately to the formation length C1 of the imbrication-like formation S1 shown in FIG. 2.

For pushing the printing products 10 arriving in imbricated formation S together, in order to form the imbrication-like formations S1 shown in FIGS. 2 and 3, a pushing element 32, only schematically indicated in FIG. 1, may be used. The pushing element is moved relative to the imbricated formation S in the direction indicated by arrow A. In so doing, the pushing element 32 engages the trailing end 24 of the imbricated formation S and brings this end 24 closer to the leading end 22, stopping at and, therefore, leaving the distance corresponding to the formation length C1. Friction between the individual printing products 12 then automatically results in the imbrication-like formation S1 shown in FIGS. 2 and 3, or a very similar formation. It is also possible to convey the imbricated formation S (FIG. 1) in t he direction of arrow A, for example, by means of the belt conveyor 14, against a buffer element 34, indicated by dot-dashed lines in FIG. 2. If such a buffer element is used, it should be provided, on the side facing the imbrication-like formation S1, with a contour which corresponds to the shape of the envelope of the imbrication-like formation S1, at least in that region in which the imbrication spacing is shortened. For further conveyance of the thus formed imbrication-like formation S1 in the direction indicated by arrow A, the buffer element 34 can be removed from the conveying area by known means.

The imbrication-like formation S1 is rolled up, beginning at the leading end 22, in the direction indicated by arrow D to form a printing product roll 30, as is indicated in FIG. 3. FIGS. 5 and 6 show the imbrication-like formations S1 represented in FIGS. 2 and 3 after they have been rolled up, together with the wrapping element 26, into bundles 35. The bundles 35 are ready to dispatch and are able to be easily manipulated by hand. In these bundles 35, the innermost printing product, i.e., the one which is most forward in the imbrication-like formation S1 in the direction indicated by arrow A, is indicated by reference number 10. The wrapping element 26, rolled up together with the imbrication-like formation S1 (FIG. 4), overlaps this innermost printing product 10 in the bundle 35, separates the helicoidally arranged winding layers of the rolled-up imbrication-like formation S1 from one another, and reaches, with its rear end region 28, around the entire printing product roll 30 in such a way that it overlaps itself in a region denoted by 36. If the wrapping element 28 is a plastic sheet having self-adhesive properties, this overlapping in the region 36 results in the bundle 35 holding itself together.

Since, in the case of the imbrication-like formation shown in FIG. 3, the wrapping element 26 overlaps the latter only slightly in the rear end section 20, the wrapping element 26 is not wound up during rolling-up of the imbrication-like formation S1. Rather, the wrapping element comes to lie exclusively on the outside circumference of the printing products 1 after they have been rolled up to form a bundle or printing product roll 30. In this case as well, the overlapping of the forward and rear regions of the wrapping element 26 overlap in the overlapping region 36 so that bundle 35 can hold itself together. It is, of course, also possible to use a material which is not self-holding as the wrapping element 26. In this case, a cord can be laid around the bundle 30 to hold it in shape, or the rear end of the wrapping element 26 can be fixed in place by other known means, such as adhesive strips.

Figure 4:
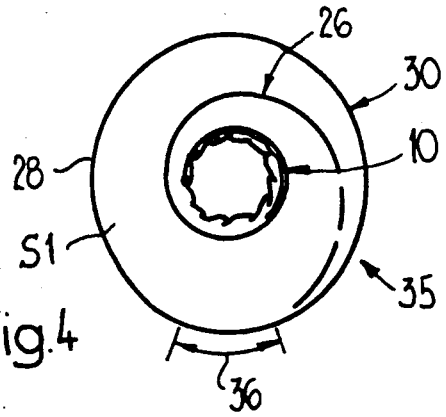
FIGS. 4 and 5 show bundles formed by rolling up the imbrication-like formations shown in FIGS. 2 and 3.

Since the imbrication-like formations S1 are thin in the forward end section 16, due to the relatively great imbrication spacings B in arrow direction E, as seen in FIGS. 2 and 3, they can initially be rolled up with a small diameter, which results in small, stable bundles 35 which are easy to handle, as FIGS. 4 and 5 show. The cylindrical bundles 35 have approximately a circular cross-section. During winding-up of each imbrication-like formation S1, a thick region of the imbricated formation S1, as seen in the radial direction, comes to lie over a thinner region of the formation. These cross-sections result in bundles of approximately circular cross-sections.

Figure 7:
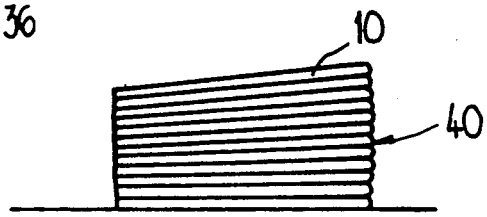
FIG. 7 shows a stack formed by pushing the printing products shown in FIG. 4 onto one another.

The roll-shaped bundles 35, containing the printing products 10, are sent to the end user. The end user lays a bundle 35 on a support 38, schematically represented in FIG. 6, releases the rear end of the wrapping element 26, and unrolls the bundle 35. The printing products 10 are then arranged in an imbrication-like formation which corresponds to the formation S1 prior to rolling-up, as can be seen by a comparison of FIG. 2 and FIG. 6. The folded edges 12 of the printing products 10 may, in this case, be bent upwards somewhat, due to bending of these edges during the rolling-up process. Since the formation length C1 is chosen such that the ends 22, 24 can be grasped by both hands of the same person at the same time, it is then possible, by pushing the ends 22, 24 toward each other by hand, to easily form from the printing products 10 in a stack 40, such as is shown in FIG. 7. The individual printing products !0 can then be taken from the top of this stack.

Figure 8:
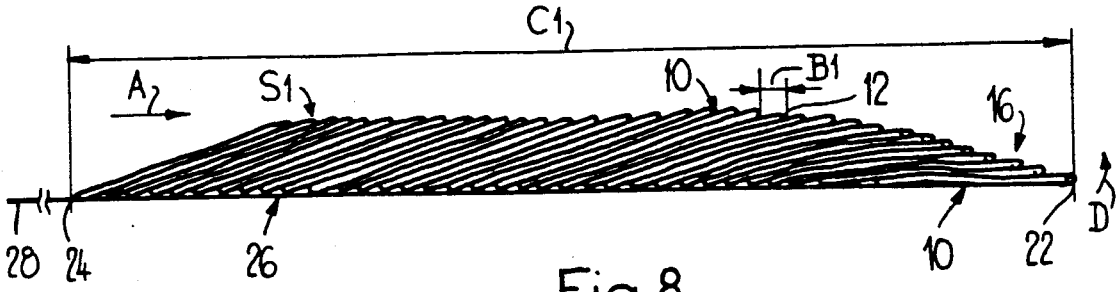
FIG. 8 shows an imbrication-like formation having approximately constant imbrication spacing and smaller formation length in relation to the length of the imbrication formation according to FIG. 1.
Figure 9:
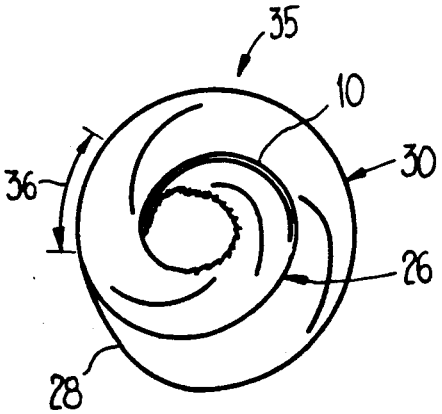
FIG. 9 shows a bundle formed by rolling up the imbrication-like formation according to FIG. 8.

In FIG. 8, a further imbrication-like formation S1 is shown. In this formation, however, the imbrication spacing B1 between the folded edges 12 of successive printing products 10 is reduced to an approximately constant amount. This imbrication-like formation S1 also is formed from the imbricated formation S shown in FIG. 1, by pushing all the printing products 10 together. This can take place, for example, by driving the front belt conveyor of two belt conveyors arranged in series at a lower conveying speed than the rear belt conveyor. The formation length C1 of the imbrication-like formation S1 shown in FIG. 8 is chosen such that the leading end 22 and the trailing end 24 can be grasped by the hands of one person. The wrapping element 26 overlaps virtually the entire imbrication-like formation 10 and has a rear end region 28 which projects beyond the trailing end 24 in order to separate the windings from one another during rolling-up, in the same way as previously described, and to reach, with its rear end region 28, around the printing product roll 30 and hold the bundle 35 together. Such a bundle 35 is shown in FIG. 9. The region in which two sections of the wrapping element 26 overlap each other and bear against each other is denoted by reference number 36.

In FIG. 9, the innermost printing product, which corresponds to the forwardmost printing product, in the direction of arrow A, shown in FIG. 8, is denoted by reference number 10. The wrapping element 26 overlaps certain regions of this printing product 10. It should be noted that the imbrication-like formation S1 shown in FIG. 8 is also thinner in the forward end section 16 than in the middle region. As a result, again, it is possible to produce a printing product roll 30 with a center of small free inside diameter. The center may, in this case, be arranged eccentrically with respect to the approximately circular periphery of the bundle 35.

As in the previous case, the bundle 30 is unrolled by the end user and, by pushing the ends 22 and 24 toward each other by hand, a stack 40, such as is shown in FIG. 7, is formed from the imbrication-like formation S1.

Figure 10:
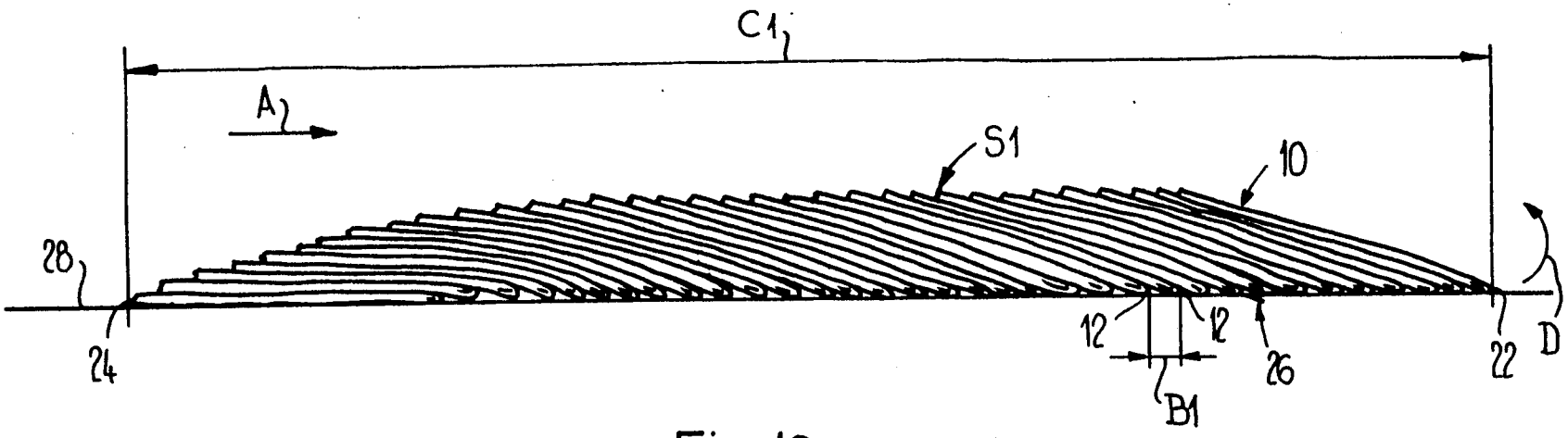
FIG. 10 shows an imbrication-like formation similar to the formation shown in FIG. 8, having a different lay of the printing products.

FIG. 10 shows an imbrication-like formation similar to the imbrication-like formation S1 illustrated in FIG. 8, but the lay of the printing products 10 within the imbrication-like formation S1 is different. As seen in conveying direction A of the imbrication-like formation S1, in the formation shown in FIG. 10, the folded edges 12 of each printing product 10 are leading. Edges 12 are located at the bottom of the formation, so that each printing product 10 rests on the following one. This imbrication-like formation S1 is also formed by an imbricated formation having a great imbrication spacing, in which each printing product rests on the following one, by pushing together uniformly all of the printing products 10, so that the imbrication spacing B1 between the folded edges 12 of successive printing products 10 is reduced to an approximately constant amount. A longitudinal section through the imbrication like formation S1 thus formed has, approximately, the shape of a trapezoid.

Also, in the case of the imbrication-like formation S1 shown in FIG. 10, the formation length C1 is chosen such that the leading end 22 and the trailing end 24 can be grasped with the hands by one person. The rear end region 28 of the wrapping element denoted by reference number 26 projects beyond the trailing end 24 in the same way as previously described. The imbrication-like formation S1 is rolled together in arrow direction D to form a bundle, which is held together by the wrapping element 26 The bundle is unrolled by the end user and, from the imbrication-like formation S1 thus obtained again, a stack is formed by pushing the ends 22, 24 towards each other by hand, in the manner explained previously. The winding-up of the imbrication-like formation S1 shown in FIG. 10 in the direction of arrow D also allows the removal of individual printing products 10 from the center of the printing product roll.

Figure 11:
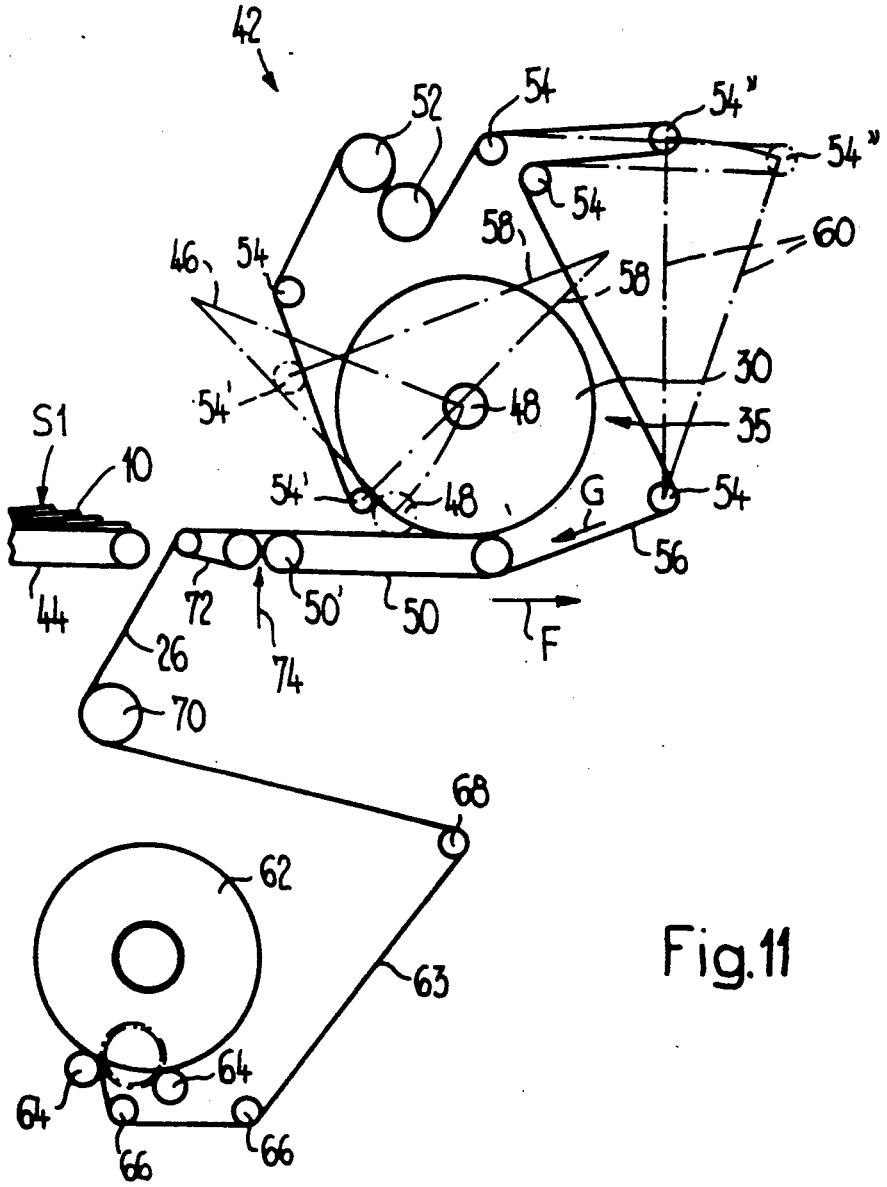
FIG. 11 shows a device for the rolling-up of imbrication-like formations.

FIG. 11 shows a winding device 42 for winding up the printing products 10, delivered in an imbrication-like formation S1, into a printing product roll 30, and wrapping the same with the wrapping element 26. The construction and mode of operation of this winding device 42 is represented and described in detail in European Patent Application 243 906 and corresponding U.S. Pat. No. 4,811,548. For this reason, the winding device 42 is only described hereafter to the extent necessary for an understanding of FIG. 11. The device has a winding mandrel 48, mounted so as to be freely rotatable on a swivel arm 46, indicated by dot-dashed lines. Underneath the winding mandrel 48, there is provided a band conveyor 50. An endless band 56, led around a pair of drive rollers 52 and a plurality of deflection rollers 54, 54', 54'', wraps around the winding mandrel 48 or the printing products 10 wound up thereupon, and is led around the deflection roller 50', facing the belt conveyor 44, of the band conveyor 50. With the exception of the deflection rollers denoted by 54' and 54'', the deflection rollers 54 are fixedly mounted. The deflection roller 54', arranged upstream of the winding mandrel 48, as seen in the direction indicated by arrow F, is mounted so as to be freely rotatable on a further swivel arm, denoted by 58. The arm can be swiveled back and forth between the two end positions, indicated by dot-dashed lines. The deflection roller denoted by 54'' is likewise arranged on a swivel arm 60, which is prestressed in the clockwise direction, in order to keep the band 56 taut and to compensate for the change in length of the part of the band 56 reaching around the winding mandrel 48 or the printing products 10 wound-up thereupon. The band conveyor 50 can be displaced, in the direction indicated by arrow F, out of the operating position shown in FIG. 11 and into a rest position, in which the conveyor no longer touches the finished bundle 30, for ejection of the finished bundle from the winding mandrel 48.

Underneath the band conveyor 50, there is set, on two bearing rollers 64, a supply reel 62, with plastic sheet 63 wound-up thereupon. The wrapping element 26, mentioned above, consists of a section of this plastic sheet 63. The plastic sheet 63 is led from the supply reel 62 around two deflection rollers 66, a tensioning roller 68, and a schematically indicated controlled release roller 70. From the latter, the plastic sheet 63 runs to a tensioning device 72, designed as a belt conveyor and arranged between the belt conveyor 44 and the band conveyor 50. Between the tensioning device and the band conveyor 50, there is provided a cutting device 74, indicated by an arrow, which is able to swivel, in the direction indicated by the arrow, into the conveying path of the plastic sheet 63 to detach a section of plastic sheet 63, thus forming the wrapping element 26.

The winding device 42 operates as follows. At the beginning of the winding operation, the winding mandrel 48 is in its lower end position, indicated by dot-dashed lines, in which it rests on the band conveyor 50, which is in operating position. The band 56, extending along the upper side of the band conveyor 50 from the deflection roller 50', wraps around the winding mandrel 48 and runs from the latter to the deflection roller 54', which is in the lower end position shown by solid lines. The band 56 is driven by means of the drive rollers 52 in the direction indicated by arrow G at approximately the same speed as the belt conveyor 44, which delivers the imbrication-like formation S1. The latter is additionally provided on the underside with the plastic sheet 63, drawn off from the supply reel 62. The band 56 then lays the imbrication-like formation S1 against the winding mandrel 48, in order to form from it the printing product roll 30. In so doing, the plastic sheet 63 is wound up with it. Due to the increase in diameter of the printing product roll 30 resting on the band conveyor 50, the swivel arm 46 is successively swiveled towards the upper position, in which the winding mandrel 48 is in the position shown in FIG. 11 by solid lines. In order to take into account the differing thickness of the delivered imbrication-like formation S1 during the rolling-up operation, the deflection roller 54' can be swiveled in the direction towards its upper end position and back, according to this thickness, by means of the further swivel arm 58. For this purpose, the thickness of the imbrication-like formation S1 can, for example, be scanned and the further swivel arm 58 controlled so as to swivel correspondingly, in order to allow the imbrication-like formation S1 to pass through and between the band conveyor 50 and the deflection roller 54'. As soon as the entire imbrication-like formation S1 has been wound onto the winding mandrel 48 and the necessary length of the rearwardly projecting rear end region 28 of the plastic sheet 63 has been drawn past the cutting device 74, the cutting device is activated in order to detach the wrapping element 26 from the remaining part of the plastic sheet 63. The band 56 is then driven until the rear end region of the wrapping element 26 bears completely against the printing product roll 30. To eject the finished bundle 35 from the winding mandrel 48, the further swivel arm 58 is swiveled into the upper end position and the band conveyor 50 is displaced in arrow direction F, so that the winding mandrel 48 can be lowered, together with the bundle 35, into the lower position, in which the winding mandrel 48 is drawn in dot-dashed lines. In the lower position of the winding mandrel, the swivel arm 46 is disposed against a stop (not shown). Thereafter, the finished bundle 35 is ejected from the winding mandrel 48 by means of a push rod (likewise not shown).

In order to keep the plastic sheet 63 taut so that it can be properly provided to the imbrication-like formation S1, the tensioning device 72, designed as a belt conveyor, is constantly driven in conveying direction and has the plastic sheet 63 always bearing against it. The plastic sheet 63 is either held back by means of the release roller 70, if the imbrication-like formation S1 is not to be additionally provided with plastic sheet 63, or released, in order to provide additionally this plastic sheet 63. The prestressed tensioning roller 68 keeps the plastic sheet 63 taut in the region between the supply reel 62 and the release roller 70 and, by the formation of a supply loop, prevents an abrupt over-stressing of the plastic sheet 63.

It is also conceivable to wind up the imbrication-like formation S1 by means of different winding stations of any type.

It is, of course, also conceivable to arrange the printing products 10 in the imbricated formation S and in the imbrication-like formation S1 in such a way that the open side edge, opposite the folded edge 12, is leading. It would, of course, also be conceivable to wind up the imbrication-like formation S1 from the other end or, in a direction opposite to the direction indicated by arrow D.

Moreover, is also possible, while pushing the printing products 10, arriving in imbricated-formation S, towards one another, to reduce the imbrication spacing in stages. The printing products 10 are, in this case, pushed towards one another in such a way that a number of successive printing products have the same imbrication spacing, and then, the imbrication spacing is reduced, in each case, for a number of following printing products 10.

It is also conceivable, in order to push together the printing products 10 arriving in the imbricated formation S, to arrange, downstream of the belt conveyor 14 shown in FIG. 1 a further belt conveyor, the conveying speed of which is controlled such that, when passing over from one belt conveyor 14 to the other, the printing products 10 are pushed towards one another to the desired imbrication spacing B, B1.

For the sake of completeness, it should also be noted that the dimension of the length C of the imbricated formation S may be governed by the number of printing products 10, which are, after all, arranged at approximately equal imbrication spacings B.

I claim:

1. A method of processing printing products, such as newspapers, periodicals and the like, comprising the steps of:

providing an imbricated formation of the printing products, having a certain length and an approximately equal imbrication spacing;

pushing said printing products together, to form an imbrication-like formation from said imbricated formation, said imbrication-like formation having a formation length smaller than said certain length, and to shorten said imbrication spacing;

rolling the imbrication-like formation up from one end to form a printing product roll;

wrapping the printing product roll to keep the printing product roll together for forming a bundle;

dispatching the bundle so that it can be manipulated by hand; and unrolling the bundle so that the printing products can be pushed, one on top of the other, to form a stack.

2. The method as claimed in claim 1, wherein, while pushing said printing products together, the imbrication spacing is reduced to an approximately constant amount.

3. The method as claimed in claim 1, wherein, while pushing said printing products together, the imbrication spacing, in a region at a distance from said one end, is reduced in relation to the imbrication spacing in an end section adjoining said one end.

4. The method as claimed in claim 3, wherein the imbrication spacing is reduced continuously in the end section.

5. The method as claimed in claim 1, wherein printing products are pushed towards one another to form the imbrication-like formation.

6. The method as claimed in claim 1, wherein printing products are pushed towards one another from a second end, remote from said one end.

7. The method as claimed in claim 6, wherein material for wrapping the printing product roll is brought together with the imbrication-like formation, overlapping the imbrication-like formation at least in certain regions, and projecting beyond the second end remote from said one end, and is rolled up with said formation into said bundle.

8. The method as claimed in claim 7, wherein essentially all the printing products in the imbrication-like formation are overlapped by the material.

9. The method as claimed in claim 7, wherein only printing products in the region of the second end in the imbrication-like formation are overlapped by the material.

10. The method as claimed in claim 1, wherein the bundle is unrolled for removing at least one of the of printing products, the printing products then lying again in the imbrication-like formation and being pushed one on top of the other by hand to form said stack.

11. The method as claimed in claim 1, wherein said imbrication-like formation includes a region of greater thickness, due to the reduction in imbrication spacing, and a front region of smaller thickness, said regions arranged one over the other, as seen in radial direction, in said bundle in order to give the bundle approximately a cylindrical shape.

12. The method as claimed in claim 3, wherein the imbrication spacing is reduced in stages in the end section.

* * * * *